US012733703B2

(12) United States Patent
Vignal et al.

(10) Patent No.: US 12,733,703 B2
(45) Date of Patent: Sep. 15, 2026

(54) KNITTED GARMENT COLLAR COMPRISING A FIRST CURVED FLEXIBLE PORTION AND A SECOND STRUCTURED STITCH CURVED RIGID PORTION, METHOD FOR MANUFACTURING SUCH A COLLAR AND GARMENT COMPRISING SUCH A COLLAR

(71) Applicant: LACOSTE OPERATIONS, Paris (FR)

(72) Inventors: Patrick Vignal, Sainte Savine (FR); David Ratier, Villadin (FR); Marie Christine Disle, Belley (FR)

(73) Assignee: LACOSTE OPERATIONS, Paris (FR)

( * ) Notice: Subject to any disclaimer, the term of this patent is extended or adjusted under 35 U.S.C. 154(b) by 0 days.

(21) Appl. No.: 18/537,860

(22) Filed: Dec. 13, 2023

(65) Prior Publication Data

US 2024/0197013 A1 Jun. 20, 2024

(30) Foreign Application Priority Data

Dec. 14, 2022 (FR) ..... FR2213382

(51) Int. Cl.
*A41D 27/18* (2006.01)
*A41B 3/00* (2006.01)
(Continued)

(52) U.S. Cl.
CPC ..... *A41D 27/18* (2013.01); *A41B 3/005* (2013.01); *D04B 1/14* (2013.01); *D04B 1/246* (2013.01);
(Continued)

(58) Field of Classification Search
CPC ..... A41D 27/18; A41B 3/00; A41B 3/005; A41B 5/00; A41B 2500/10; D04B 1/14;
(Continued)

(56) References Cited

U.S. PATENT DOCUMENTS 2,514,646 A * 7/1950 Johnson ..... A41D 27/18 2/60
2,584,834 A * 2/1952 Bevins ..... D04B 1/106 2/90

(Continued)

FOREIGN PATENT DOCUMENTS

CN 209846188 U 12/2019
CN 113412982 A * 9/2021

*Primary Examiner* — Aiying Zhao
(74) *Attorney, Agent, or Firm* — S.J. INTELLECTUAL PROPERTY LTD.

(57) ABSTRACT

A collar of a knitted garment, in particular a polo, comprises a first flexible knitted portion comprising a substantially curve shaped outer longitudinal end; a second structured stitch rigid knitted portion, distinct from the first portion and constituting the collar stand, comprising a substantially curve shaped outer longitudinal end, this second portion being linked to the first portion; and a substantially curved longitudinal fold axis of the first portion, so that this first portion is folded along the longitudinal fold axis to cover a portion of the first portion and the entirety of the second portion. This collar further defines a height H1 between each outer longitudinal end at its central portion and a height H2 at both of its two lateral ends.

9 Claims, 2 Drawing Sheets

(51) Int. Cl.

| | |
|---|---|
| ***D04B 1/14*** | (2006.01) |
| ***D04B 1/24*** | (2006.01) |
| ***D04B 21/14*** | (2006.01) |
| ***D04B 21/20*** | (2006.01) |

(52) U.S. Cl.
CPC ..... *D04B 21/14* (2013.01); *D04B 21/207* (2013.01); *A41B 2500/10* (2013.01); *D10B 2201/02* (2013.01); *D10B 2501/06* (2013.01)

(58) Field of Classification Search
CPC ..... D04B 1/24; D04B 1/246; D04B 21/14; D04B 21/207
See application file for complete search history.

(56) References Cited

U.S. PATENT DOCUMENTS

| | | | | |
|---|---|---|---|---|
| 3,293,662 | A * | 12/1966 | Seiler | D04B 1/24 66/171 |
| 6,167,732 | B1 * | 1/2001 | Friedman | D04B 1/24 66/170 |
| 2009/0282604 | A1 * | 11/2009 | Litt | D06J 1/12 2/139 |
| 2021/0127758 | A1 * | 5/2021 | Morisch Hurst | A41B 17/00 |
| 2023/0000175 | A1 * | 1/2023 | Williams | A41B 5/00 |

* cited by examiner

KNITTED GARMENT COLLAR COMPRISING A FIRST CURVED FLEXIBLE PORTION AND A SECOND STRUCTURED STITCH CURVED RIGID PORTION, METHOD FOR MANUFACTURING SUCH A COLLAR AND GARMENT COMPRISING SUCH A COLLAR

FIELD OF THE INVENTION

The present invention relates to the field of garment (or clothing item) making by knitting. More particularly, the invention relates to a collar of a knitted garment, for example a casual polo (usually referred to by the English expression "casual wear") or a sports polo (for example a golf polo), and a method for manufacturing such a collar by knitting, this method allowing stabilising said collar when worn daily or for a moving activity.

TECHNOLOGICAL BACKGROUND

The knitting technique for manufacturing textile items has been known for many years, and applies to quite various fields: clothing, medical items, filters, reinforcements for composite materials, etc.

Knitting may be practiced traditionally by hands, but knitting machines have nowadays invaded textile factories.

Knitting combines several techniques, comprising in particular the flechage knitting technique, also referred to as partial knitting. It consists in placing the needles of the knitting machine in standby on a portion of the cloth, at the level of one row, while the other needles are working, thereby allowing obtaining knits having different heights. The longer a needle is placed in standby, the shorter the height of this stitch column will be. Thus, it is possible to confer specific shapes on the knitted element, for example a curved shape, as disclosed in particular in the U.S. Pat. No. 3,293,662 A. This technique allows manufacturing by knitting only textiles having specific shapes, while eliminating a material cutting step. It also has the advantage of being economical and having a positive impact on the environment, thanks to the material saving and the waste reduction allowed by this method, thanks to the elimination of the material cutting step.

However, when applied to make a garment collar, for example a polo collar, this technique does not specifically allows ensuring a better hold of the collar when worn, neither does it allows ensuring a better fall of the latter when moving, in particular during a relatively intense sports movement.

A conventional knitting technique is ribbed knitting, which consists in regularly alternating stitches knitted at the front and others knitted at the back, over the same row. The stitches at the front confer volume, whereas those at the back are recessed. 1&1 ribbed knitting specifically refers to an alternation of one stitch at the front and one stitch at the back.

Another known knitting technique is the structured stitch knitting technique, which involves a knit bonding that is more rigid than 1&1 ribbing. Indeed, the ribs are known to the very elastic. Thus, the structured stitch allows conferring more rigidity and thickness on the textile compared to a more flexible rib which will fold much more easily. It also allows avoiding the expandable effect of the rib.

Nowadays, most garment collars are made in a jacket collar fashion, using a warp-and-weft type fabric. This technique involves the manufacture of several subassemblies which will form the collar, for example one strip for the collar and two strips for the collar stand.

Hence, this making technique has the drawback of being relatively long, in particular when it is desired to provide a quality collar that features a good hold and an adequate fall. Most collars have the disadvantage of rising easily when moving, and even in daily wear, thereby displeasingly uncovering the seam in the back. Besides, such a manufacturing process does not avoid material losses, in particular by textile section cutting to confer a specific final shape on the collar.

Thus, there is a need for a solution allowing, by one single knitting technique, proposing a garment collar, in particular a polo collar, which would feature a good hold in daily wear as well as during a more intense movement, for example when practicing a sports activity, and the process of manufacturing of which would be simplified and would allow reducing the costs and the environmental impact.

DISCLOSURE OF THE INVENTION

Thus, the Inventors of the present invention have succeeded in designing a knitted garment collar which comprises at least two distinct portions, a relatively flexible one and the other more rigid, this collar having a curved shape. For this purpose, they have developed a method for manufacturing such a collar which implements the flechage knitting technique and the structured stitch knitting technique.

For this purpose, the invention provides, according to a first object, a collar of a knitted garment, in particular a polo, comprising:

- a first flexible knitted portion comprising a rectilinear shaped inner longitudinal end and a substantially curve shaped outer longitudinal end;
- a second structured stitch rigid knitted portion, distinct from said first portion and constituting the collar stand, this second portion comprising a rectilinear shaped inner longitudinal end corresponding to the inner longitudinal end of the first portion and a substantially curve shaped outer longitudinal end, this second portion being linked to the first portion at the inner longitudinal end; and
- a substantially curve shaped longitudinal fold axis of the first portion, this axis being located in the first portion, parallel to its outer longitudinal end, so that this first portion is folded along the longitudinal fold axis to cover a portion of the first portion and the entirety of the second portion. This collar further comprises two rectilinear shaped lateral ends, and defines a height H1 between each outer longitudinal end at its central portion and a height H2 at each of its two lateral ends, with H1 equal to or larger than H2.

Hence, the invention is based on a quite novel and original approach of proposing a collar having at least two structurally distinct sections, made by two specific knitting techniques, in order to ensure a better wear of the collar on a daily basis as well as improved hold and replacement of this collar during larger or more intense movements, such as when practicing a sports activity. The first and second portions of the collar according to the invention are knitted according to the flechage knitting technique, which allows conferring a specific circle-arc final shape on the two outer longitudinal ends of the collar, and that being so without having to carry out a material cutting step, which systematically results in a material loss and therefore wastes. Indeed, this technique, which allows knitting sections of the collar while other sections are in standby, allows conferring shapes on the collar, in particular at the outer longitudinal ends, which collars could thus adopt a configuration other than rectilinear. In the case of the invention, it is particularly desired to obtain circle-arc shaped collar outer longitudinal ends. Hence, the design of such a collar is simplified and less expensive, since less material is used to obtain this curved shape. The manufacture of this collar also has the advantage of having a positive impact on the environment, since less wastes are produced and therefore discarded, these not being always easy to recycle. This flechage knitting technique also allows forming a collar whose dimensions are not uniform over the entire element. This means that this collar with its circle-arc shaped ends could have different heights over its length. Hence, the collar of the invention has a height at its centre that is larger than the height at its two ends. In particular, this enables the portion of the collar the farthest from the collar stand and which could fold at the neck along a longitudinal axis to be longer at its central portion than at its lateral outer ends. Advantageously, this feature allows for an optimum fall of the collar at the back, for a better hold in daily wear. Flechage knitting also allows manufacturing a collar which, when it is folded along the previously-described longitudinal fold axis, covers the seam present at the collar/garment junction, i.e. between the collar stand and the rest of the garment in the top portion of the back, which seam could be considered inelegant. Indeed, thanks to the curved shape of the outer longitudinal end of the first portion, the phenomenon of detachment of the edge of the collar is avoided, thereby avoiding revealing the backside seam.

The second portion of the collar according to the invention is also knitted by the structured stitch knitting technique, which, in turn, allows stiffening the element of the collar thus knitted. The collar of the invention has its collar stand portion designed in this manner. The combination of this rigid portion at the collar stand with the more flexible portion of the rest of the collar allows enhancing the improved hold of the collar for daily wear. This also enhances the advantage of an optimised replacement of the collar after a movement that is more intense than daily gestures, in particular when practicing a sports activity or a recreational activity which involves large movements.

According to one embodiment, the height H1 is comprised between 7 cm and 10 cm, preferably between 8.5 cm and 9.5 cm.

According to one embodiment, the height H2 is comprised between 5 cm and 8 cm, preferably between 6.5 cm and 7.5 cm.

These dimensions are suitable to design a collar according to the invention which entirely covers the seam at the collar/garment connection, once the collar is folded. A collar having these heights is also configured to ensure a good hold and an improved replacement, both in daily wear and when practicing a physical activity.

According to another embodiment, the collar according to the invention is made in one-piece. Thus, the process of mounting thereof on the garment is facilitated and comprises a reduced number of steps compared to mounting collars according to the prior art.

According to still another embodiment, the second portion of the structured stitch collar extends over a height at its central portion comprised between 0.5 cm and 2.5 cm, preferably between 1 cm and 2 cm.

These height dimensions at the collar stand are enough for the collar according to the invention to feature improved hold and replacement.

According to another embodiment, the collar is made of cotton or of a synthetic material, and preferably made of cotton.

Thus, the collar according to the invention is designed with materials that are easily available, easy to handle and modulate and relatively inexpensive.

The invention also provides, according to a second object, a method for manufacturing such a collar, comprising:

- at least one step of manufacturing a first flexible knitted portion;
- at least one step of manufacturing by structured stitch knitting a second rigid knitted portion, distinct from the first portion and constituting the collar stand;
- these two manufacturing steps involving the flechage knitting technique and being done successively.

This method allows designing a collar as defined before, and having all of the advantages of the invention.

According to one embodiment, the structured stitch knitting step is carried out according to a technique selected from among Milano knitting, Interlock knitting, double-face knitting, tubular knitting or ribbed/tubular combined knitting, said at least one structured stitch knitting step being preferably carried out according to the Milano knitting technique.

This particular technique enables the textile thus knitted to feature enough rigidity and thickness to properly ensure the function of the collar stand, yet without making this rigidity excessive, in order not to make mounting of the collar to the garment difficult.

A third object of the invention relates to a garment comprising a collar as defined before.

According to one embodiment, this garment is a polo.

LIST OF THE FIGURES

Other aims, features and advantages of the invention will appear more clearly upon reading the following description, given merely as an illustrative and non-limiting example, with reference to the figures, wherein.

DETAILED DESCRIPTION OF AN EMBODIMENT OF THE INVENTION

The general principle of the invention is based on the design of a garment collar implementing at least two knitting techniques, which collar thus has two distinct knitted sections. This combination of knitting techniques enables this innovative collar to have a better hold for daily wear, in comparison with the collars of the prior art, while also ensuring improved hold and replacement of the collar when practicing a sports activity, or to the very least when practicing an activity involving a more energetic gesture than daily gestures. Indeed, it is known that wearing a polo-type garment, comprising a foldable collar, generally has the drawback of its user having his/her collar easily unfolded, and in particular during intense movements, for example when practicing a sports activity such as golf, implying the player performing large gestures with the shoulders and the arms, and more generally with all of his/her body top. This non-optimum hold of the collar is also often associated with the disadvantage of uncovering the seam present at the collar/garment junction. Also, the collars of the prior art designed by one single knitting technique, including no flechage knitting, involve a material cutting step in the process of manufacturing thereof, in particular for collars having a non-rectilinear shape, for example a curved shape at their ends. This cutting step makes the common process of manufacturing the collars more complex and more expensive, implying a greater material use than actually necessary to obtain the final collar, as well as the generation of wastes, which could be avoided.

Figure 1:
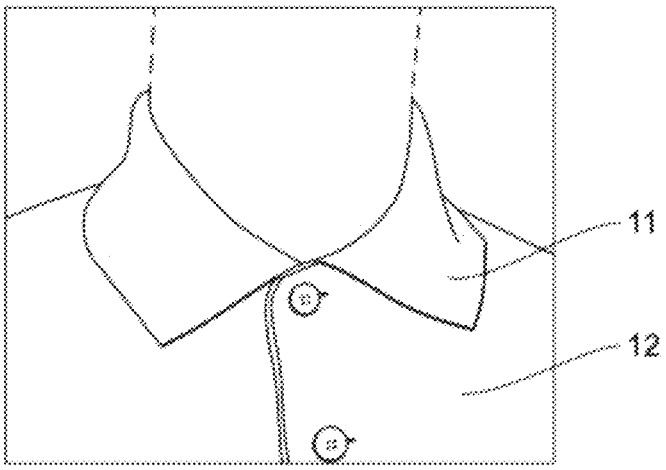
FIG. 1 shows an overview of a collar designed according to the method of the invention, which collar is a polo collar.

Hence, the Inventors of the present invention propose a collar as illustrated in FIG. 1, according to a particular embodiment. This collar 11 combines a rigid knitted portion at the collar stand, obtained by structured stitch knitting, and a corresponding flexible knitted portion in the rest of the collar, these two portions being designed moreover by flechage knitting. This collar 11 is herein integrated to the final garment 12, which is a golf polo for men.

However, it should be noted that the collar according to the invention could be suited to garments other than golf polos for men, and could in particular be used for polos adapted for practicing other sports, and even polos for recreation activities or for daily wear. This collar according to the invention may also be configured for polos intended for women and children. It may also be integrated on garments other than polos.

Hence, this collar 11 is a collar that folds on itself along a longitudinal fold axis, located in the flexible upper portion of the collar, unlike so-called mao collars for example. These are rather used on jacket-type garments. They are small, upstanding, straight and short, and do not have flaps to fold.

Figure 2:
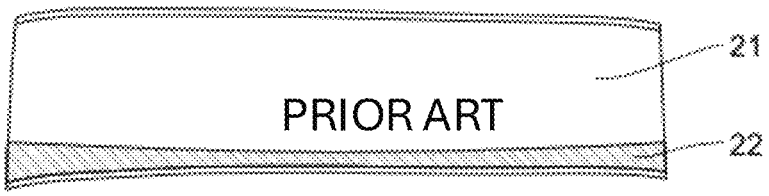
FIG. 2 illustrates a collar designed according to a known method of the prior art, wherein the curved shape of the collar is obtained by material cutting.

Such a collar 11 according to the invention may be made of cotton or of a synthetic material, or of any other material suited for garment making. Cotton is a preferred material since many advantageous characteristics are associated therewith. Indeed, this is a material that has some insulating capability, and is soft, comfortable and flexible. It is also hypoallergenic and enables skin breathing. This is a material that absorbs dyes easily, thereby allowing offering garments with quite various colours. It is also easy to maintain and generally inexpensive. However, there are several cotton types, whose costs could vary, thereby affecting the price of the final garment. This collar 11 according to the invention is particular in that it has both external longitudinal ends thereof curve shaped, and this feature is obtained by a manufacturing method that does not advantageously comprise any material cutting step, but which involves the implementation of the flechage knitting technique; Indeed, this technique advantageously allows conferring shapes other than rectilinear on the knitted textile elements, and that being so directly through the knitting process itself. FIG. 2 allows illustrating this conventional material cutting step of the process of manufacturing collars of the prior art which have a non-rectilinear shape. In this figure, the section 21 corresponds to a portion of the final collar, one end of which is curve shaped, whereas the hatched section 22 corresponds to a portion of the knitted material which will be cut to allow obtaining the curve shaped final portion 21. This material cutting step of the prior art disadvantageously implies the use of a larger amount of knitting material than actually necessary to manufacture the final collar 21. Hence, such a method for designing a collar according to the prior art involves greater material costs. This method is also more complex, to the extent that it comprises at least one additional step compared to the method according to the invention. Moreover, this additional cutting step has the disadvantage of generating material wastes, which results in a negative impact on the environment, in particular in the case where the waste material is not or hardly recyclable. The method for manufacturing a collar according to the invention allows obtaining such a collar 11 both outer longitudinal ends of which have a curved shape while eliminating this material cutting step.

Figure 3:
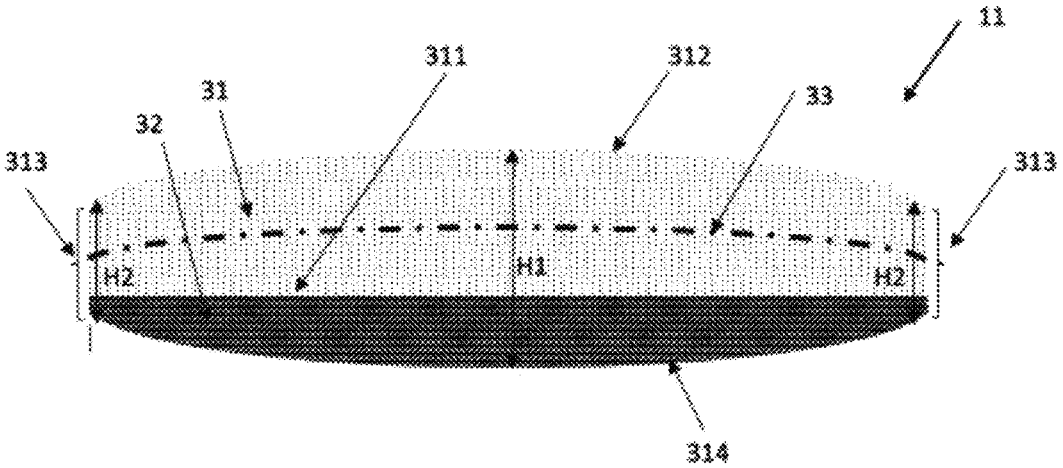
FIG. 3 shows a diagram of a collar designed according to the method of the invention, wherein the different heights H1 and H2 of the collar are indicated.

Thus, the collar according to the invention is illustrated, when it is still not integrated to the final garment, in FIG. 3, which clearly distinguishes the two knitted portions forming the collar still according to this same embodiment. Thus, the collar 11 has a first section 31, knitted by 1&1 ribbing. However, this section may be knitted by ribbing other than 1&1 ribbing, or else according to another knitting technique which allows conferring some expandability on the knitting. The reference 311 in FIG. 3 designates the rectilinear shaped inner longitudinal end of the second portion 32 corresponding to the inner longitudinal end of the first portion 31.

The collar 11 also has a second section 32, knitted in structured stitches. These two sections are also knitted by the flechage knitting technique. The method for manufacturing a collar combining these techniques, and in particular structured stitch knitting and flechage knitting, may be executed on a knitting machine, for example such as those equipping textile factories. In general, such a knitting machine corresponds to a standard knitting machine, which comprises for example specific options to be able to implement these two knitting techniques according to the invention successively. For example, such a knitting machine may be controlled by a computer program, comprising instructions to implement the flechage knitting technique when desired, and also to implement the structured stitch knitting technique when desired. The knitting method according to the invention could probably also be implemented entirely by hand, without using a knitting machine.

As explained hereinbefore, the flechage knitting technique for making a collar according to the invention allows modulating the outer ends of the collar according to a circle arc shape, in particular the outer end 312 of the first section 31 and the outer end 314 of the second section 32. According to the particular embodiment of a collar for a golf polo for men, these two ends are symmetrical and are convex. Thus, the central portion of the collar 11 logically has a height H1 different from the height H2, which corresponds to the two lateral ends 313 of the entire collar. In particular, H1 is larger than H2. According to this embodiment, the height H1 amounts to 9 cm and the height H2 amounts to 7 cm. However, these values are not fixed for the collar of the invention, and could vary depending on several parameters: the garment type (such as a polo), the user type (man, woman, child) and the size of the user, the activity type associated with the garment (for example a sports polo, such as a golf polo, or a casual wear polo). Thus, more generally, the height H1 for a collar according to the invention is comprised between 7 cm and 10 cm, preferably between 8.5 cm and 9.5 cm, and the height H2 is comprised between 5 cm and 8 cm, preferably between 6.5 cm and 7.5 cm.

The section 31 is knitted by 1&1 ribbing, which is a conventional knitting method consisting in regularly alternating stitches knitted at the front and others knitted at the back over the same row. As seen before, this section 31 involves the flechage knitting technique on these 1&1 rib points, in order to confer a specific final shape on the outer longitudinal end 312 of this section 31, in particular a curved shape. Thus, thanks to its 1&1 rib points, this section 31 is relatively expandable. In contrast, the structured stitch of the section 32 confers stiffness and thickness on that element. Thus, this section 32 features a greater rigidity than the flexible upper section 31. This structured stitch section 32 is also thicker than the section 31. It is located at the collar stand, which is a strategic location to ensure an adequate hold of the collar. The structured stitch knitting may consist of Milano knitting, Interlock knitting, double-face knitting, tubular knitting or ribbed/tubular combined knitting. In this embodiment, the section 32 is Milano knitted, which has the advantage of conferring enough rigidity and thickness on the textile to properly ensure the function of the collar stand, yet without making this rigidity excessive, which could then make mounting of the collar to the garment difficult.

This section 32 is also knitted by flechage knitting, allowing conferring a curved shape on the outer longitudinal end 314 of this section.

This section 32 extends, at its central portion, over a 1 cm height for this embodiment (golf polo collar for men). But this height is more generally comprised between 0.5 cm and 2 cm, and preferably between 1 cm and 2 cm, with regards to the different parameters applicable to the invention, such as mentioned hereinbefore.

This collar 11 according to the invention also comprises a longitudinal fold axis 33, which is adapted so that the portion of the flexible section 31 located above this axis folds along the latter to cover the portion of the section 31 located below this axis and the section 32. This axis follows the curvature of the outer end 312 of the first section 31. The central height H1 of the collar being larger than the height H2 of its lateral ends 313, the section 31 thus folded allows hiding the seam that connects the collar to the rest of the polo, and which is often considered inelegant.

Hence, the combination of the sections 31 and 32 for the collar 11 according to the invention allows obtaining a collar that advantageously features an improved hold for daily wear, such as for casual wear, and also allows for optimised hold and replacement of the collar when the latter might be displaced by daily wear or by a more intense activity, such as a sports activity, like golf swing.

Figure 4:
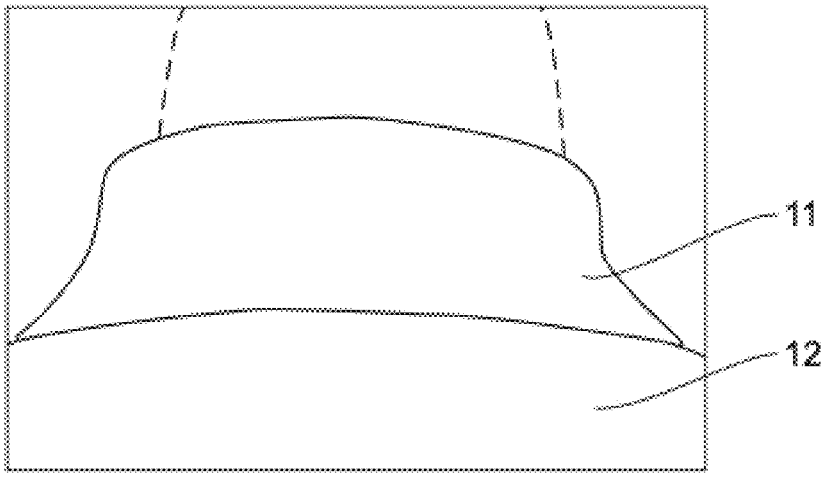
Fig. 4 PRIOR ART
FIG. 4 illustrates the rear portion of a collar according to the invention, where the seam at the collar/garment connection is hidden by the folded collar.

A back view of the collar 11 according to the invention, integrated to a polo 12, is illustrated in FIG. 4. This figure illustrates that, thanks to the specific height H1 of the middle of the collar, larger than the height of the rest of the collar, the seam localised at the collar/garment connection is entirely covered by the collar, when the latter is folded. This height H1 also enables the collar, once folded, to rise relatively higher in the neck of the user, thereby ensuring a better protection against weather factors, such as the sun or the wind.

Figure 5:
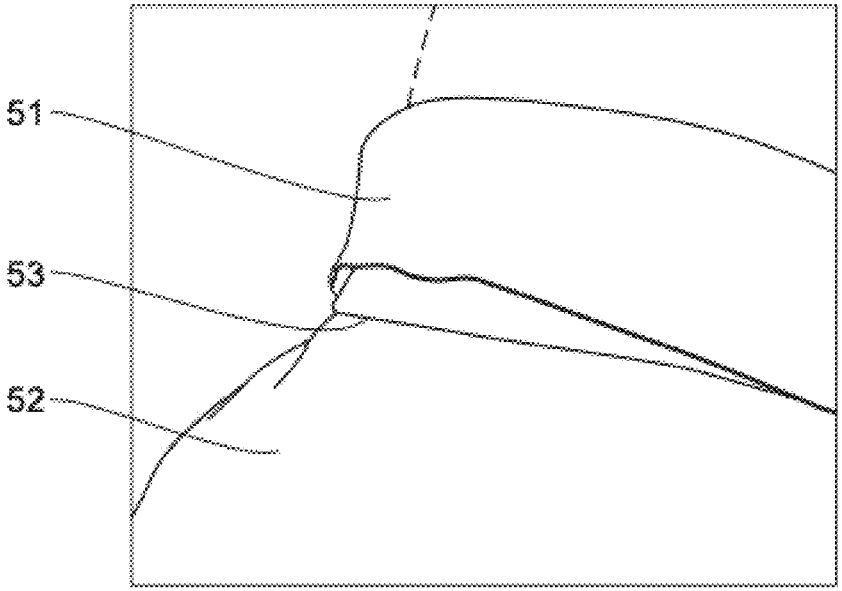
FIG. 5 illustrates the rear portion of a collar of the prior art, where the seam at the collar/garment connection is visible once the collar is folded.

In comparison, a collar of the prior art 51 is illustrated in FIG. 5. It clearly shows that, when this collar 51 is integrated to the garment 52 by a seam 53, the latter remains visible when the collar is folded. It is also visible that such a collar 51 rises less significantly in the neck, thereby protecting it from external factors (rain, wind, cold, sun, etc.).

The invention claimed is:

1. A collar of a knitted garment, comprising:

a first flexible knitted portion comprising a rectilinear shaped inner longitudinal end and a curve-shaped outer longitudinal end;

a second Milano knitted portion, said second portion being distinct from and more rigid than said first portion and constituting a collar stand, said first and second portions of the collar being knitted according to a flechage knitting technique, said second portion comprising a rectilinear shaped inner longitudinal end corresponding to said inner longitudinal end of said first portion and a curve-shaped outer longitudinal end, said second portion being linked to said first portion at said inner longitudinal ends of said first and second portions; and a curve-shaped longitudinal fold axis of said first portion, said longitudinal fold axis being located in said first portion, parallel to said outer longitudinal end of said first portion, so that an upper portion of said first portion located above the fold axis is folded along said longitudinal fold axis to cover a lower portion of said first portion located below the fold axis and the entirety of said second portion;

said collar comprising two rectilinear shaped lateral ends; and said collar, when unfolded, defining a height (H1) between said outer longitudinal end of said first portion and said outer longitudinal end of said second portion at a central portion of said collar, and a height (H2) at each of the two lateral ends of said collar, with (H1) larger than (H2).

2. The collar of a knitted garment according to claim 1, wherein said height (H1) is between 7 cm and 10 cm.

3. The collar of a knitted garment according to claim 1, wherein said height (H2) is between 5 cm and 8 cm.

4. The collar of a knitted garment according to claim 1, wherein said collar is made in one-piece.

5. The collar of a knitted garment according to claim 1, wherein said second portion of said structured stitch collar extends over a height at a central portion of said collar between 0.5 cm and 2.5 cm.

6. The collar of a knitted garment according to claim 1, wherein said collar is made of cotton or of a synthetic material.

7. A garment comprising a collar as defined according to claim 1.

8. The garment according to claim 7 being a polo.

9. Method for manufacturing a collar of a knitted garment according to claim 1, said method comprising:

at least one step of manufacturing the first flexible knitted portion of said collar;

at least one step of manufacturing by a Milano knitting technique the second knitted portion of said collar, distinct from and more rigid than said first portion and constituting the collar stand, the at least one step of manufacturing said first portion and the at least one step of manufacturing said second portion involving a flechage knitting technique and being done successively.

* * * * *